US012497714B2

(12) United States Patent
Nakamura

(10) Patent No.: US 12,497,714 B2
(45) Date of Patent: Dec. 16, 2025

(54) ARTIFICIAL HAIR AND METHOD FOR PRODUCING ARTIFICIAL HAIR

(71) Applicant: KANEKA CORPORATION, Osaka (JP)

(72) Inventor: Yu Nakamura, Hyogo (JP)

(73) Assignee: KANEKA CORPORATION, Osaka (JP)

( * ) Notice: Subject to any disclaimer, the term of this patent is extended or adjusted under 35 U.S.C. 154(b) by 230 days.

(21) Appl. No.: 18/374,495

(22) Filed: Sep. 28, 2023

(65) Prior Publication Data

US 2024/0026572 A1 Jan. 25, 2024

Related U.S. Application Data

(63) Continuation of application No. PCT/JP2022/016928, filed on Mar. 31, 2022.

(30) Foreign Application Priority Data

Apr. 30, 2021 (JP) ..... 2021-077496

(51) Int. Cl.
*D01D 11/00* (2006.01)
*A41G 3/00* (2006.01)

(52) U.S. Cl.
CPC ..... *D01D 11/00* (2013.01); *A41G 3/00* (2013.01)

(58) Field of Classification Search
None
See application file for complete search history.

(56) References Cited

U.S. PATENT DOCUMENTS

| | | | |
|---|---|---|---|
| 4,930,527 | A | 6/1990 | Makishima et al. |
| 2011/0271976 | A1 | 11/2011 | Sasayama |
| 2020/0288801 | A1 | 9/2020 | Muraoka et al. |

FOREIGN PATENT DOCUMENTS

| | | | |
|---|---|---|---|
| JP | S63-219608 | A | 9/1988 |
| WO | 2010/038679 | A1 | 4/2010 |
| WO | 2019/172147 | A1 | 9/2019 |

OTHER PUBLICATIONS

International Preliminary Report on Patentability issued in corresponding International Application No. PCT/JP2022/016928 mailed Oct. 24, 2023 (5 pages).

*Primary Examiner* — Arti Singh-Pandey
(74) *Attorney, Agent, or Firm* — Osha Bergman Watanabe & Burton LLP

(57) ABSTRACT

A fluffy and voluminous artificial hair and a method for producing the same are provided. Artificial hair including a fiber cord with one or more fiber bundles braided or spirally wound has a configuration in which the fiber bundle is a bundle of a plurality of fibers including a first fiber and a second fiber. A cross section orthogonal to a longitudinal direction of the fiber bundle has a core and a shell enclosing the core. The core has a blend of the first fiber and the second fiber. The shell consists of the second fiber. A total area of voids in the shell on the cross section is larger than a total area of voids in the core on the cross section.

8 Claims, 6 Drawing Sheets

ARTIFICIAL HAIR AND METHOD FOR PRODUCING ARTIFICIAL HAIR

TECHNICAL FIELD

One or more embodiments of the present invention relate to artificial hair and a method for producing artificial hair.

BACKGROUND

Conventionally, artificial hair fibers resembling human hair have been used as material of head accessories such as wigs, extensions, and hair bands (such as Patent Document 1).

For example, Patent Document 1 discloses an artificial hair fiber bundle using two types of artificial hair fibers made of polyester resin and polyamide resin. According to Patent Document 1, the artificial hair fiber bundle has combability, texture, and luster similar to human hair, and flame resistance as well as good curl setting.

PATENT DOCUMENTS

Patent Document 1: WO2019/172147 A

In recent years, random and bulky styles have come to be preferred in head accessories for women.

However, the artificial hair using the artificial hair fiber bundle described in Patent Document 1 has a regular and uniform shape with neither volume nor originality.

SUMMARY

In one or more embodiments, a fluffy and voluminous artificial hair and a method for producing the same are provided.

According to one aspect of one or more embodiments of the present invention, provided is artificial hair including a fiber cord including one or more fiber bundles braided or spirally wound, the fiber bundle including a plurality of fibers including a first fiber and a second fiber, the plurality of fibers being bundled together, wherein a cross section orthogonal to a longitudinal direction of the fiber bundle includes: a core; and a shell enclosing the core, the core including the first fiber and the second fiber in a mixed state, the shell consisting of the second fiber, and wherein a total area of voids in the shell on the cross section is larger than a total area of voids in the core on the cross section.

According to this aspect, an irregular, fluffy and voluminous shape can be obtained.

It is preferable that the fiber bundle has a ratio of a shell area to a core area on the cross section larger than a ratio of mass of the second fiber to that of the first fiber.

It is preferable that the second fiber comes from an inside of the core, passes through a gap between the adjacent first fibers, and reaches the shell.

It is preferable that the shell area is larger than the core area on the cross section.

It is preferable that a minimum thickness of the shell in the cross section is 0.1 mm or more.

"Minimum thickness" as used herein refers to a thickness of the thinnest portion, and "minimum thickness of the shell" refers to a thickness of the thinnest portion among portions where the shell is present.

"Thickness of the shell" as used herein refers to a distance from the outer surface of the core to the outer surface of the shell.

It is preferable that a mass of the second fiber is 20 to 80 parts by mass based on a total of 100 parts by mass of the first and second fibers.

It is preferable that the mass of the second fiber is 50 parts by mass or more based on a total of 100 parts by mass of the first and second fibers.

According to another aspect of one or more embodiments of the present invention, provided is a method for producing artificial hair, including the steps of: (a) forming a fiber cord by braiding a fiber bundle or by winding a fiber bundle around a rod-shaped body, the fiber bundle being formed by bundling a plurality of fibers including a first fiber and a second fiber; and (b) heating the fiber cord at a heating temperature equal to or more than a softening point of the first fiber, wherein the first fiber has a thermal shrinkage of 10% or more when heated at the heating temperature for 10 to 90 minutes whereas the second fiber has a thermal shrinkage of 5% or less when heated at the heating temperature for 10 to 90 minutes.

"Thermal shrinkage" as used herein refers to thermal shrinkage of a non-processed fiber material before and after heating.

Thermal shrinkage (%)={(length before heating)−(length after heating)}/(length before heating)×100. The same applies hereinafter.

"Softening point" as used herein refers to a temperature at which a thermal shrinkage of 5% occurs. The same applies hereinafter.

According to this aspect, the first fiber having a higher thermal shrinkage is shrunk by heating in the heating step, and the second fiber having a relatively lower thermal shrinkage as compared to the first fiber is narrowed due to the shrunken first fiber and gently expanded outward, so that an irregular, fluffy and voluminous shape can be achieved.

It is preferable that a softening point of the second fiber is higher than the softening point of the first fiber by 60° C. or more.

It is preferable that a difference between the thermal shrinkage of the first fiber and the thermal shrinkage of the second fiber is 15% or more when heated at the heating temperature for 10 to 90 minutes.

It is preferable that the heating temperature is lower than the softening point of the second fiber.

It is preferable that a total length of the fiber cord after step (b) is 0.2 to 0.7 times compared to a total length of the fiber cord before step (b).

It is preferable that the fiber cord is heated for 15 minutes to 2 hours in step (b).

It is preferable that a mass of the second fiber is 20 to 80 parts by mass based on a total of 100 parts by mass of the first and second fibers.

It is more preferable that a mass of the second fiber is 50 parts by mass or more based on a total of 100 parts by mass of the first and second fibers.

It is preferable that the first fiber is a polyvinyl chloride-based fiber.

It is preferable that the second fiber is a polyester-based fiber, an acryl-based fiber, or a nylon-based fiber.

According to the artificial hair and the method for producing artificial hair of one or more embodiments of the present invention, it is possible to achieve the more fluffy and bulky shape as compared to the conventional hairs.

BRIEF DESCRIPTION OF THE DRAWINGS

FIGS. 2A and 2B are explanatory views of a fiber cord shown in FIG. 1, wherein FIG. 2A is a front view of the fiber cord, and FIG. 2B is an end view of an A-A cross section of the fiber cord illustrated in FIG. 2A. A boundary portion between a core and a shell is represented by a virtual line, and the second fiber is represented with dotted points.

FIGS. 3A and 3B are explanatory views of a heating step for the artificial hair in FIG. 1, wherein FIG. 3A shows a front view before the heating step, and FIG. 3B shows a front view after the heating step.

FIGS. 5A to 5E illustrate photographs of artificial hairs according to examples and comparative examples of one or more embodiments of the present invention, wherein FIG. 5A shows a front view (upper photograph) and a cross section view (lower photograph) of Example 1-1, FIG. 5B shows a front view (upper photograph) and a cross section view (lower photograph) of Example 1-2, FIG. 5C shows a front view (upper photograph) and a cross section view (lower photograph) of Example 1-3, FIG. 5D shows a front view (upper photograph) and a cross section view (lower photograph) of Example 1-4, and FIG. 5E shows a front view (upper photograph) and a cross section view (lower photograph) of Comparative Example 1-1.

FIGS. 6A to 6E illustrates photographs of artificial hairs according to examples and comparative examples of one or more embodiments of the present invention, wherein FIG. 6A shows a front view (upper photograph) and a cross section view (lower photograph) of Example 2-1, FIG. 6B shows a front view (upper photograph) and a cross section view (lower photograph) of Example 2-2, FIG. 6C shows a front view (upper photograph) and a cross section view (lower photograph) of Example 2-3, FIG. 6D shows a front view (upper photograph) and a cross section view (lower photograph) of Example 2-4, and FIG. 6E shows a front view (upper photograph) and a cross section view (lower photograph) of Comparative Example 2-1.

DETAILED DESCRIPTION

One or more embodiments of the present invention will be described in detail hereinafter.

Artificial hair 1 according to a first embodiment of the present invention is a hair accessory attached to the head of a user, and is attached to the user's hair directly and/or to a knitted portion knitted with the user's hair when using.

The artificial hair 1 is so-called bulk hair, and various styles can be enjoyed by, for example, directly knitting the artificial hair 1 on the user's hair, or hooking the artificial hair 1 on real hair (cornrow) knitted so as to creep over the scalp using a needle.

Figure 1:
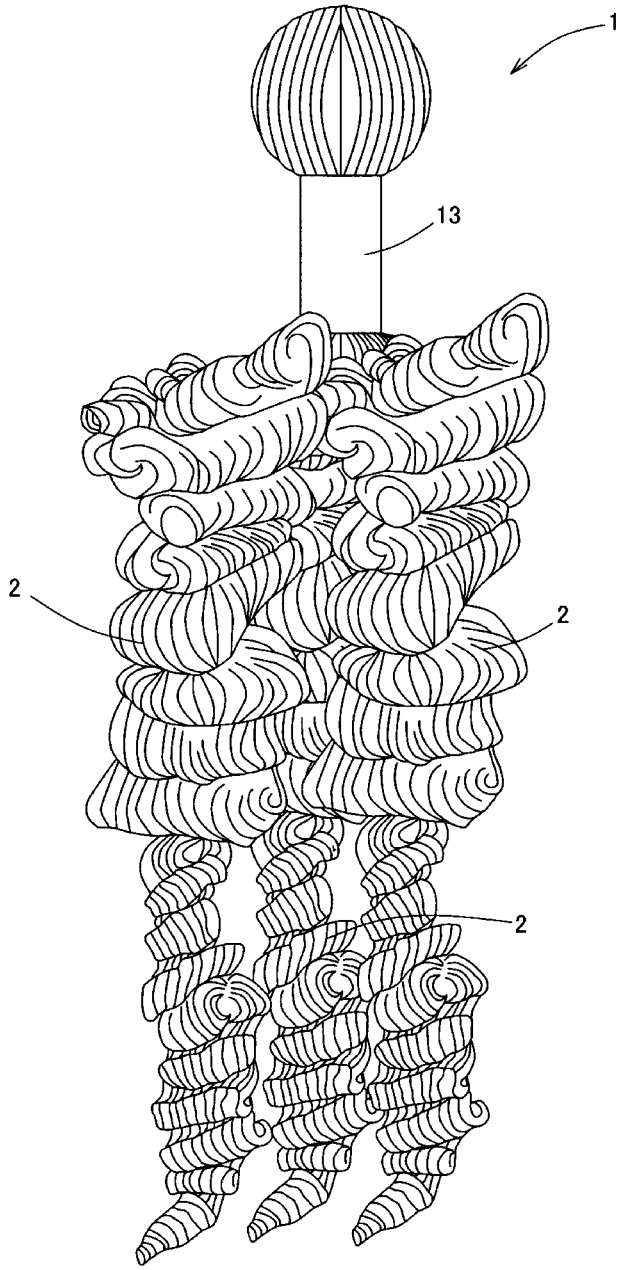
FIG. 1 is a front view schematically illustrating artificial hair according to a first embodiment of the present invention.

As shown in FIG. 1, the artificial hair 1 includes one or more fiber cords 2, and each of the fiber cords 2 can be attached to the hair or the braided portion.

The artificial hair 1 of one or more embodiments includes a plurality of fiber cords 2, and one end side (an end side on the root side) in a length direction of the fiber cords 2 is connected via a connecting portion 13.

Figure 2B:
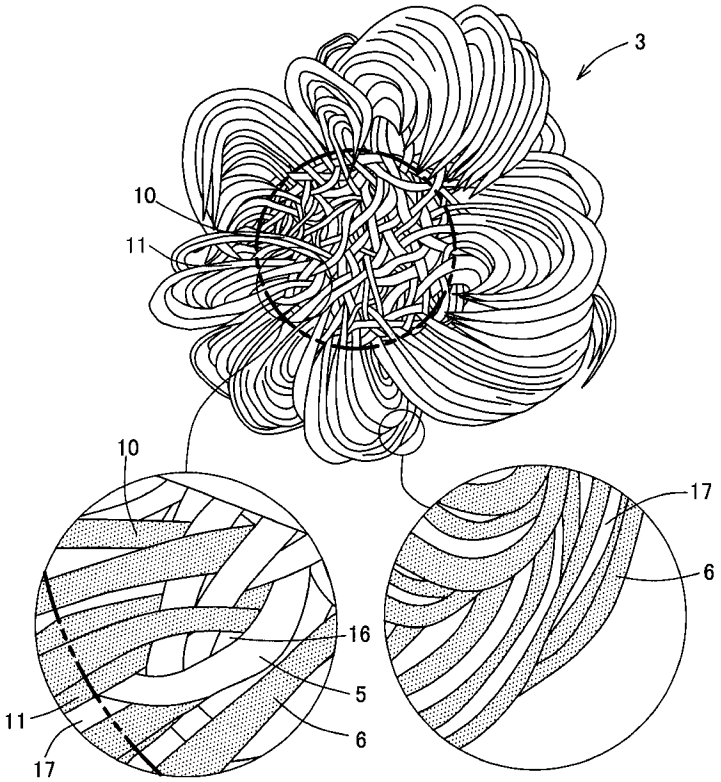
Figure 2A:
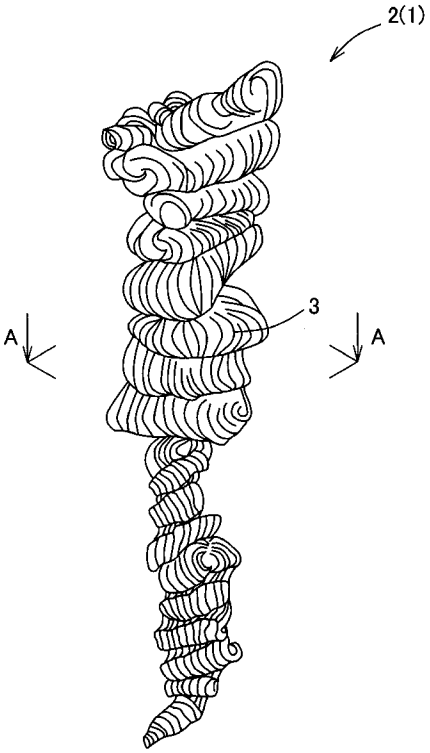

As illustrated in FIG. 2A, the fiber cord 2 is formed by interweaving a plurality of fiber bundles 3 into a cord shape, and extends in the length direction.

As illustrated in FIG. 2B, the fiber bundle 3 is a bundle of a plurality of fibers including at least two types of fibers, a first fiber 5 and a second fiber 6.

The fiber bundle 3 of one or more embodiments is composed of two types of fibers, the first fiber 5 and the second fiber 6.

The first fiber 5 is a thread-like artificial hair fiber and is made of thermoplastic resin.

The first fiber 5 is a highly shrinkable fiber having a higher thermal shrinkage than the second fiber 6, and is a shrink fiber that compresses the second fiber 6.

A softening point of the first fiber 5 preferably falls within a range of 50° C. to 100° C. The thermal shrinkage of the first fiber 5 in an extending direction when heated at 100° C. for 60 minutes is preferably 10% to 80%, more preferably 15% to 70%, and still more preferably 40% to 60%.

The thermal shrinkage of the first fiber 5 when heated at a heating temperature T1 in a heating step, which will be described later, for 10 minutes to 90 minutes is preferably 10% or more, more preferably 15% to 70%, and still more preferably 40% to 60%.

As the first fiber 5, for example, a polyvinyl chloride-based fiber can be used.

The second fiber 6 is a thread-like artificial hair fiber and is made of thermoplastic resin.

The second fiber 6 has a thermal shrinkage relatively smaller than that of the first fiber 5 when heated at the softening point of the first fiber 5, and can be called a low-shrinkage fiber when the first fiber 5 is a high-shrinkage fiber.

The second fiber 6 has a smaller thermal shrinkage than the first fiber 5 when heated at 100° C. for 60 minutes, and the thermal shrinkage when heated at 100° C. for 60 minutes preferably exceeds 0% and is 5% or less, more preferably 4% or less, and still more preferably 3% or less.

The thermal shrinkage of the second fiber 6 when heated at a heating temperature T1 in a heating step that will be described later for 10 to 90 minutes (for 10 minutes or more to minutes or less) preferably exceeds 0% and is 5% or less, more preferably 4% or less, and still more preferably 3% or less.

A difference between the thermal shrinkage of the first fiber 5 and the thermal shrinkage of the second fiber 6 when heated at a heating temperature T1 in a heating step that will be described later for 10 minutes to 90 minutes is preferably 15% or more, more preferably 25% or more, and still more preferably 40% or more.

A softening point of the second fiber 6 is a temperature higher than the softening point of the first fiber 5, and is preferably higher than the softening point of the first fiber 5 by or more, more preferably by 60° C. or more, still more preferably by 70° C. or more, and particularly preferably higher than the softening point of the first fiber 5 by 100° C. or more.

The second fiber 6 preferably has a Young's modulus falling in the range of 4.5 GPa to 10 GPa according to JIS L 1015: 2010.

As the second fiber 6, for example, a polyester-based fiber, an acryl-based fiber, or a nylon-based fiber, can be used.

Examples of polyester-based fibers that can be used for the second fiber 6 include polyalkylene terephthalates such as polyethylene terephthalate, polytrimethylene terephthalate, and polybutylene terephthalate.

Examples of acryl-based fibers that can be used for the second fiber 6 include acrylic fibers, and among these, modacrylic fiber is preferred.

The term "modacrylic fiber" as used herein refers to an acrylic fiber in which the weight ratio of acrylonitrile is 35% or more and lower than 85%.

Examples of nylon-based fibers that can be used for the second fiber 6 include Nylon 6, Nylon 66, and a copolymer of Nylon 6 and Nylon 66.

As illustrated in FIG. 2B, the fiber bundle 3 has a core (core part) 10 and a shell (shell part) 11 on a cross section orthogonal to the longitudinal direction.

The core 10 is a portion where the first fiber 5 and the second fiber 6 are blended, and is a substantially circular portion.

A ratio of a cross-sectional area of the first fiber 5 in the core 10 is larger than a ratio of an area of the second fiber 6 in the core 10. That is, the first fiber 5 occupies most of the core 10.

The cross-sectional area of the first fiber 5 in the core 10 is preferably 80% or more, more preferably 90% or more, and still more preferably 95% or more of the cross-sectional area of the entire core 10.

The area of the second fiber 6 in the core 10 is preferably 20% or less, more preferably 10% or less, and still more preferably 5% or less of the cross-sectional area of the entire core 10.

As shown in FIG. 2B, the shell 11 is formed to surround the periphery of the core and is a part composed only of the second fibers 6.

The minimum thickness of the shell 11 (the distance from the outer surface of the core 10 to the outer surface of the shell 11) is preferably 0.1 mm or more, and more preferably 5 mm or more, from the viewpoint of adjusting the tactile sensation of the shell 11 depending on the type of the second fiber 6.

The area density of the shell 11 is preferably smaller than the area density of the core 10.

The term "area density" as used herein refers to a mass per unit area.

The shell 11 preferably has the area porosity larger than the area porosity of the core 10. That is, as illustrated in FIG. 2B, the total area of voids 17 of the shell 11 is larger than the total area of voids 16 of the core 10 on the cross section orthogonal to the longitudinal direction in the fiber bundle 3.

The term "area porosity" as used herein refers to a ratio of gaps (voids) per unit area.

In the fiber bundle 3, the area of the shell 11 is preferably equal to or larger than the area of the core 10, and the area of the shell 11 is more preferably larger than the area of the core 10.

In the fiber bundle 3, the area ratio of the shell 11 to the core 10 is preferably larger than a ratio of the mass of the second fiber 6 to the mass of the first fiber 5.

In this way, the fiber cord 2 can have a fluffy tactile sensation.

In the fiber bundle 3, the second fiber 6 passes through a gap between the adjacent first fibers 5 from the inside of the core 10 to reach the shell 11. That is, the first fiber 5 and the second fiber 6 are entangled with each other in the core 10.

The connecting portion 13 is a portion that brings together the proximal end side of each fiber cord 2, and is configured by a known connecting unit such as a thread, a string, an adhesive tape or an adhesive.

A method for producing the artificial hair 1 of one or more embodiments will be described hereinbelow.

The artificial hair 1 of one or more embodiments mainly performs a fiber cord forming step, a nonwoven fabric attaching step, a heating step, and a heat dissipation step in this order.

In other words, in the method for producing the artificial hair 1, first, a plurality of fiber bundles 3 are formed by bundling the first fiber 5 and the second fiber 6, and then the plurality of fiber bundles 3 are braided to form the fiber cord 2 (fiber cord forming step).

In particular, the first fiber 5 and the second fiber 6 are cut into arbitrary sizes and weighed, and the first fiber 5 and the second fiber 6 cut for each predetermined mass are bundled together to form two fiber bundles 3. The roots of the two fiber bundles 3 are fixed to a fixing member, and two fibers are knitted from the root side (one end side).

The length of the fibers 5 and 6 to be cut at this time can be appropriately changed according to the length of the artificial hair 1 to be manufactured, but it should be preferably between 20 inches and 50 inches.

The mass ratio of the first fibers 5 to the fiber bundle 3 is preferably 0.2 or more and or less, more preferably 0.3 or more and 0.7 or less, and still more preferably 0.5 or less, from the viewpoint of sufficiently squeezing the second fibers 6 by thermal shrinkage. That is, the amount (mass) of the first fiber 5 is preferably 20 parts by mass or more and 80 parts by mass or less (20 to 80 parts by mass), more preferably 30 parts by mass or more and 70 parts by mass or less, and still more preferably 50 parts by mass or less based on a total of 100 parts by mass of the first fiber 5 and the second fiber 6.

The mass ratio of the second fiber 6 to the fiber bundle 3 is a value at which the sum of the mass ratio of the second fiber 6 and the mass ratio of the first fiber 5 is 1, and is preferably or more and 0.8 or less, more preferably 0.3 or more and 0.7 or less, and still more preferably or more from the viewpoint of sufficiently covering the periphery of the first fiber 5. That is, the amount (mass) of the second fiber 6 is preferably 20 parts by mass or more and 80 parts by mass or less (20 to 80 parts by mass), more preferably 30 parts by mass or more and 70 parts by mass or less, and still more preferably 50 parts by mass or more with respect to 100 parts by mass of the total of the first fibers 5 and the second fibers 6.

The mass ratio of the second fiber 6 to the fiber bundle 3 is preferably equal to or more than the mass ratio of the first fiber 5 to the fiber bundle 3.

Figure 3A:
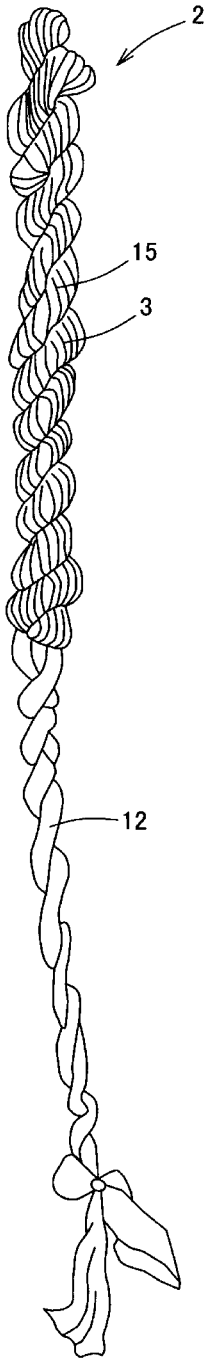

As illustrated in FIG. 3A, a nonwoven fabric 12 is wound around a part of the outer periphery of the fiber cord 2 formed in the fiber cord forming step (nonwoven fabric attaching step).

At this time, the nonwoven fabric 12 is preferably wound in a range of 1/10 or more and 1/2 or less, and more preferably wound in a range of 1/3 or less of the total length of the fiber cord 2 from the tip side of the fiber cord 2 (the distal end side of the fiber cord 2).

The fiber cord 2 around which the nonwoven fabric 12 is wound in the nonwoven fabric attaching step is introduced into a heating device such as an oven and heated under the conditions of a heating temperature T1 and a heating time t1 (heating step).

Figure 3B:
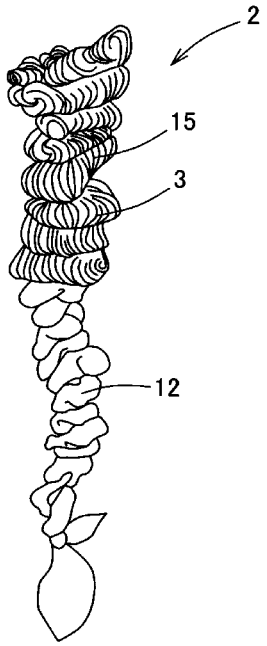

At this time, as illustrated in FIG. 3A and FIG. 3B, a portion of the fiber cord 2 covered with the nonwoven fabric 12 is pressed by the nonwoven fabric 12 and is less likely to swell, and an exposed portion 15 exposed from the nonwoven fabric 12 is mainly swell. That is, the fiber cord 2 partially expands greatly in the length direction.

The heating temperature T1 at this time is preferably a temperature equal to or more than the softening point of the first fiber 5 and lower than the softening point of the second fiber 6.

Since the softening point of the first fiber 5 is different from the softening point of the second fiber 6, and the temperature of the second fiber 6 does not reach the softening point in the heating step, so that the first fiber 5 is mainly thermally shrunk, and the second fiber 6 is fastened to the first fiber 5 and tends to swell toward the outside of the first fiber 5.

A combination of the heating temperature T1 and the heating time t1 is preferably a combination in which the thermal shrinkage of the first fiber 5 is 5% or more, more preferably a combination in which the thermal shrinkage is 15% or more, and still more preferably a combination in which the thermal shrinkage is 30% or more.

The combination of the heating temperature T1 and the heating time t1 is a combination in which the thermal shrinkage of the second fiber 6 is smaller than the thermal shrinkage of the first fiber 5.

The combination of the heating temperature T1 and the heating time t1 is preferably a combination in which the thermal shrinkage of the second fiber 6 is less than 5%, more preferably a combination in which the thermal shrinkage is 2% or less, and still more preferably a combination in which the thermal shrinkage is 1% or less.

The combination of the heating temperature T1 and the heating time t1 is preferably a combination in which a difference between the thermal shrinkage of the second fiber 6 and the thermal shrinkage of the first fiber 5 is 15% or more, and more preferably a combination in which the difference is 20% or more.

Within the above range, the thermal shrinkages of the first fiber 5 and the second fiber 6 are different from each other, so that the second fiber 6 is fastened to the first fiber 5 and tends to swell outward as the first fiber 5 shrinks.

For example, when a polyvinyl chloride-based fiber is used as the first fiber 5 and a polyester-based fiber is used as the second fiber 6, the heating temperature T1 is preferably 90° C. or more and 140° C. or less.

The heating time t1 can be appropriately varied in accordance with the heating temperature T1 and the target quality, but is preferably 15 minutes to 2 hours, and more preferably minutes to 1 hour, from the viewpoint of allowing heat to permeate to the inside.

The total length of the fiber cord 2 after the heating step with respect to the total length before the heating step is preferably 0.2 times or more and 0.7 times or less (0.2 to 0.7 times).

The fiber cord 2 heated by the heating device in the heating step is taken out from the heating device and cooled to room temperature (heat dissipation step).

At this time, a method of cooling the fiber bundle 3 may be natural heat dissipation, or may be cooling by applying cold air at a certain constant speed, for example.

Thereafter, if necessary, the plurality of fiber cords 2 are connected by the connecting portion 13 to complete the artificial hair 1. In particular, the plurality of fiber cords 2 are connected or adhered in a range of ¼ or less of the entire length of the fiber cord 2 from one end portion of the fiber cord 2.

Additionally, a portion on the distal end side of the fiber cord 2 may be cut as necessary, and only the exposed portion 15 shown from the nonwoven fabric 12 in the heating step may be left.

According to the method for producing the artificial hair 1 of the first embodiment, the first fiber 5 and the second fiber 6 are randomly bundled, the first fiber 5 having a higher thermal shrinkage is shrunk by heating, the second fiber 6 is narrowed along with the shrinkage of the first fiber 5, and an intermediate portion of the second fiber 6 protrudes from the gap between the first fibers 5 and bulges outward in a fluffy manner. Therefore, an irregular, fluffy and voluminous shape can be obtained.

Further, according to the method for producing the artificial hair 1 of the first embodiment, the apparent Young's modulus of the second fiber 6 is 5 GPa or more and is relatively greater. Therefore, even when the second fiber 6 is narrowed by the first fiber 5 and elastically deformed inward, the second fiber 6 is restored toward the outside of the first fiber 5, and the second fiber 6 can bulge outward.

According to the artificial hair 1 of the first embodiment, the cross section of the fiber bundle 3 includes the core 10 and the shell 11, and the area density of the shell 11 is lower than the area density of the core 10. Therefore, as compared with the void 16 of the core 10, the number of voids 17 of the shell 11 is larger, and the shape has a fluffy volume.

According to the artificial hair 1 of the first embodiment, a part of the second fiber 6 constituting the fiber bundle 3 passes through the gap between the adjacent first fibers 5 from the inside of the core 10 to reach the shell 11 as illustrated in FIG. 2B. Therefore, the second fiber 6 is easily narrowed by the adjacent first fibers 5 and rise toward the outside, and the second fiber 6 is hardly removed from the core 10.

According to the artificial hair 1 of the first embodiment, since the shell 11 includes only the second fiber 6, the color and the tactile sensation of the artificial hair 1 can be adjusted by the color and the tactile sensation of the second fiber 6.

Artificial hair 101 according to a second embodiment will be described herein below. Configurations and methods similar to those of the artificial hair 1 of the first embodiment are denoted by the same reference signs, and description thereof is omitted.

A fiber cord 102 constituting the artificial hair 101 according to the second embodiment of the present invention constitute dreadlock.

Figure 4:
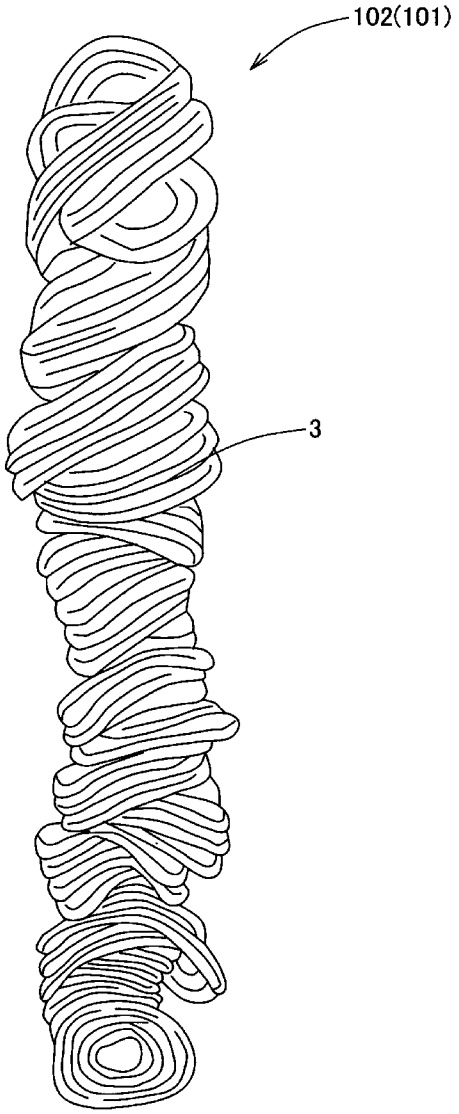
FIG. 4 is a front view schematically illustrating artificial hair according to a second embodiment of the present invention.

Similarly to the fiber cord 2 of the first embodiment, the fiber cord 102 is composed of a fiber bundle 3, and the shape of the fiber bundle 3 is different from that of the fiber cord 2. That is, as illustrated in FIG. 4, the fiber cord 102 is formed by spirally winding a fiber bundle 3.

A method for producing the artificial hair 101 of the second embodiment will be described hereinbelow.

while the artificial hair 101 of the second embodiment, similarly to the first embodiment, is configured to perform the fiber cord forming step, the heating step, and a heat dissipation step in this order, the fiber cord forming step is different from the fiber cord forming step of the first embodiment.

In the fiber cord forming step of the second embodiment, a winding step, a preheating step, and a removing step are performed.

That is, the first fiber 5 and the second fiber 6 are bundled to form the fiber bundle 3, and the formed fiber bundle 3 is wound around the outer periphery of a rod-shaped body such as a pipe (winding step).

At this time, the tip of the fiber bundle 3 is fixed, and the fiber bundle 3 is spirally wound around the rod-shaped body from one direction without being twisted. That is, the fibers 5 and 6 extend in substantially the same direction.

The outer shape of the rod-shaped body used at this time is not particularly limited, and for example, a circular shape, a polygonal shape, an elliptical shape, or an oval shape can be used.

The diameter of the minimum inclusive circle of the rod-shaped body used at this time can be appropriately changed according to the style shape of interest, but is preferably 0.06 inches or more and 0.4 inches or less.

In the winding step, the rod-shaped body around which the fiber bundle 3 is wound is introduced into a heating device and heated under conditions of a preheating temperature T2 and a preheating time t2 (preheating step).

At this time, a combination of the preheating temperature T2 and the preheating time t2 is not particularly limited as long as the shape can be maintained when the fiber bundle 3 is removed from the rod-shaped body in the removing step.

The preheating temperature T2 is preferably a temperature equal to or more than the softening point of the first fiber 5 and equal to or less than the heating temperature T1 set in the heating step.

For example, when a polyvinyl chloride-based fiber is used as the first fiber 5 and a polyester-based fiber is used as the second fiber 6, the preheating temperature T2 is preferably 80° C. or more and 100° C. or less.

The preheating time t2 is preferably 5 minutes to 30 minutes.

The rod-shaped body with the fiber bundle 3 heated in the preheating step is taken out from the heating device, and the fiber bundle 3 is removed from the rod-shaped body to form the fiber cord 102 (removing step).

At this time, curl is added to the fiber bundle 3 by heating in the preheating step, and the fiber cord 102 having the same shape as the state of being attached to the rod-shaped body is removed from the rod-shaped body.

When the fiber cord forming step is completed, the heating step and the heat dissipation step are performed as in the first embodiment, and the plurality of fiber cords 102 are connected by the connecting portion 13 to form the artificial hair 101 as necessary.

In the first embodiment described above, two fiber bundles 3 are knitted to form the fiber cord 2, but one or more embodiments of the present invention are not limited thereto. For example, three fiber bundle 3 may be braided to form a fiber cord, or two fiber bundles 3 may be braided to form a plurality of braided bodies, and the braided bodies may be interwoven to form a fiber cord.

In the first embodiment described above, the fibers 5 and 6 are randomly bundled to form the fiber bundle 3, but one or more embodiments of the present invention are not limited thereto. The fibers 5 and 6 may be regularly bundled to form a fiber bundle. For example, the second fibers 6 may be gathered on the inner side, and the first fibers 5 may be gathered on the outer side so as to surround the outer side of the second fibers 6. In this way, the second fibers 6 are narrowed by shrinkage of the first fibers 5, and the second fibers 6 can be regularly exposed to the outside.

In the first embodiment described above, the nonwoven fabric attaching step of winding the nonwoven fabric 12 around a part of the outer periphery of the fiber cord 2 is performed, but one or more embodiments of the present invention are not limited thereto. The nonwoven fabric attaching step may be omitted. For example, the heating step may be performed after the fiber cord forming step.

In the second embodiment described above, the fiber bundle 3 is wound around the rod-shaped body without being twisted in the winding step, but one or more embodiments of the present invention are not limited thereto. In the winding step, the fiber bundle 3 may be wound around the rod-shaped body while being twisted.

In the embodiment described above, the fiber bundle 3 is formed of two types of fibers, the first fiber 5 and the second fiber 6, but one or more embodiments of the present invention are not limited thereto. Three or more types of fibers including the first fiber 5 and the second fiber 6 may be combined into a fiber bundle.

In the embodiment described above, each component can be freely replaced or added in the embodiments as long as it is encompassed in the technical scope of one or more embodiments of the present invention.

EXAMPLES

Hereinafter, one or more embodiments of the present invention will be specifically described with reference to Examples, but one or more embodiments of the present invention are not limited to these Examples.

Example 1-1

A polyvinyl chloride fiber (manufactured by Kaneka Corporation, trade name: Advantage B) (hereinafter, also referred to as HI-PVC fiber) having a higher thermal shrinkage was used as the first fiber, and a flame-retardant polyester fiber (manufactured by Kaneka Corporation, trade name: Futura) (hereinafter, also referred to as PET fiber) was used as the second fiber.

The first fiber and the second fiber were each cut into 20 inches, a brush was placed on a desk such that the mass ratio of the first fiber and the second fiber was 30:70, the fiber bundled on the brush was brushed to shift the tips, and brushed so that the total length became 25 inches. The brushed fibers were bundled to form two fiber bundles, and the two fiber bundles were knitted to form a fiber cord.

A nonwoven fabric was wound around ⅓ of the entire length of the fiber cord from the tip side of the fiber cord, and the fiber cord around which the nonwoven fabric was wound was placed in an oven, heated under the conditions of a heating temperature of 90° C. and a heating time of 60 minutes, then taken out from the oven, and was left until the temperature reached room temperature.

The fiber cord thus formed was designated as Example 1-1.

Example 1-2

Except that heating was performed under the conditions of a heating temperature of 100° C. and a heating time of 60 minutes, the same procedure as in Example 1-1 was carried out to obtain a fiber cord as Example 1-2.

Example 1-3

Except that heating was performed under the conditions of a heating temperature of 120° C. and a heating time of 60 minutes, the same procedure as in Example 1-1 was carried out to obtain a fiber cord as Example 1-3.

Example 1-4

Except that heating was performed under the conditions of a heating temperature of 140° C. and a heating time of 60 minutes, the same procedure as in Example 1-1 was carried out to obtain a fiber cord as Example 1-4.

Comparative Example 1-1

Except that heating was performed under the conditions of a heating temperature of and a heating time of 60 minutes, the same procedure as in Example 1-1 was carried out to obtain a fiber cord as Comparative Example 1-1.

Example 1-5

Example 1-5 was formed in the same manner as Example 1-2, except that modacrylic fiber (manufactured by Kaneka Corporation, trade name: AFRELLE) (hereinafter, also referred to as MODA fiber) was used as the second fiber.

Example 1-6

The same procedures were carried out as in Example 1-2, except for using a polyvinyl chloride fiber (manufactured by Kaneka Corporation, trade name: ADM) (hereinafter, also referred to as a LO-PVC fiber) having a lower thermal shrinkage than HI-PVC fiber as the first fiber, to obtain a fiber cord as Example 1-6.

Comparative Example 1-2

Except that the LO-PVC fiber was used as the second fiber, the same procedure as in Example 1-2 was carried out to obtain a fiber cord as Comparative Example 1-2.

Example 1-7

Example 1-7 was formed in the same manner as Example 1-2 except that a brush was placed on a desk such that the mass ratio of the first fibers to the second fibers was 50:50, fibers bundled on the brush were brushed to shift the tips and then brushed so that the total length became 25 inches to form two fiber bundles, and two fiber bundles were knitted to form a fiber cord.

Example 1-8

Example 1-8 was formed in the same manner as Example 1-2 except that a brush was placed on a desk such that the mass ratio of the first fibers to the second fibers was 70:30, fibers bundled on the brush were brushed to shift the tips and then brushed so that the total length became 25 inches to form two fiber bundles, and two fiber bundles were knitted to form a fiber cord.

(Measurement of Softening Point)

The softening point of the fiber was measured using a thermal analyzer (SSC5200H) and a thermomechanical analyzer (TMA/SS150C) manufactured by Seiko Instruments Inc. The load defined by 10 times of the value obtained by multiplying fitness of the fiber by was applied to 10 pieces of single fibers each having 10 mm length, and the shrinkage stress in the range of 30° C. to 300° C. was measured at a temperature rising rate of 5° C./min. The temperature at which the fiber was shrunk by 5% was defined as a softening point.

(Measurement of Young's Modulus)

Using the Tensilon universal material tester (RTC-1210A) manufactured by A & D Co., Ltd., a value of Young's modulus was determined from a stress-strain curve under the condition of a tensile rate of 20 cm/min, and the average value of N=20 was taken as the Young's modulus of the sample.

(Cross-Sectional Observation)

In Examples 1-1 to 1-4 and Comparative Example 1-1, the fiber cords were frozen with liquid nitrogen, cut perpendicularly to the longitudinal direction of the fiber cords, and the cross sections were captured with a camera. The core and shell areas were calculated from the captured image of the cross section.

(Measurement of Width)

In Example 1-1 to Example 1-8, and Comparative Examples 1-1 and 1-2, widths at three positions, i.e. a position 5 cm from the upper end, a center position and a position 5 cm from the lower end, in a portion exposed from the nonwoven fabric at the time of heating were measured, and an average value was calculated.

The results of cross-section observation of Example 1-1 to Example 1-4 and Comparative Example 1-1 are shown in FIGS. 5A-5E, the measurement results of Example 1-1 to Example 1-4 and Comparative Example 1-1 are shown in Table 1, the measurement results of Example 1-2, Example 1-5, Example 1-6, and Comparative Example 1-2 are shown in Table 2, and the measurement results of Example 1-2, Example 1-7, and Example 1-8 are shown in Table 3.

TABLE 1

| | Heating Temperature | Material | Mass Ratio (%) | Thermal Shrinkage (%) | Difference in Thermal Shrinkage (%) | Area Ratio at Core | Area Ratio at Shell | Width Ratio |
|---|---|---|---|---|---|---|---|---|
| Example 1-1 | 90 | HI-PVC | 30 | 29.8 | 29.3 | 26.6% | 73.4% | 2.24 |
| | | PET | 70 | 0.5 | | | | |
| Example 1-2 | 100 | HI-PVC | 30 | 42.3 | 41.7 | 22.6% | 77.4% | 2.11 |
| | | PET | 70 | 0.6 | | | | |
| Example 1-3 | 120 | HI-PVC | 30 | 54.2 | 52.9 | 20.1% | 79.9% | 2.03 |
| | | PET | 70 | 1.3 | | | | |
| Example 1-4 | 140 | HI-PVC | 30 | 63.2 | 60.5 | 12.6% | 87.4% | 1.93 |
| | | PET | 70 | 2.7 | | | | |
| Comparative | 70 | HI-PVC | 30 | 1 | 0.9 | — | — | 1.00 |
| Example 1-1 | | PET | 70 | 0.1 | | | | |

TABLE 2

| | Heating Temperature | Material | Mass Ratio (%) | Softening Point (° C.) | Young's Modulus (GPa) | Thermal Shrinkage (%) | Difference in Thermal Shrinkage (%) | Area Ratio at Core | Area Ratio at Shell | Width Ratio |
|---|---|---|---|---|---|---|---|---|---|---|
| Example 1-2 | 100 | HI-PVC | 30 | 80.9 | 4.2 | 42.3 | 41.7 | 22.6% | 77.4% | 1.80 |
| | | PET | 70 | 212.4 | 5.6 | 0.6 | | | | |
| Example 1-5 | 100 | HI-PVC | 30 | 80.9 | 4.2 | 42.3 | 40.8 | 30.0% | 70.0% | 1.38 |
| | | MODA | 70 | 135.4 | 4.7 | 1.5 | | | | |
| Example 1-6 | 100 | LO-PVC | 30 | 99.7 | 3 | 17.8 | 17.2 | 40.0% | 60.0% | 1.52 |
| | | PET | 70 | 212.4 | 5.6 | 0.6 | | | | |
| Comparative Example 1-2 | 100 | HI-PVC | 30 | 80.9 | 4.2 | 42.3 | 24.5 | 0.0% | 0.0% | 1.00 |
| | | LO-PVC | 70 | 99.7 | 3 | 17.8 | | | | |

TABLE 3

| | Heating Temperature | Material | Mass Ratio (%) | Thermal Shrinkage (%) | Difference in Thermal Shrinkage (%) | Area Ratio at Core | Area Ratio at Shell | Width Ratio |
|---|---|---|---|---|---|---|---|---|
| Example 1-2 | 100 | HI-PVC | 30 | 42.3 | 41.7 | 22.6% | 77.4% | 1.29 |
| | | PET | 70 | 0.6 | | | | |
| Example 1-7 | 100 | HI-PVC | 50 | 42.3 | 41.7 | 44.0% | 56.0% | 1.06 |
| | | PET | 50 | 0.6 | | | | |
| Example 1-8 | 100 | HI-PVC | 70 | 42.3 | 41.7 | 68.0% | 32.0% | 1.00 |
| | | PET | 30 | 0.6 | | | | |

The thermal shrinkage is an intrinsic thermal shrinkage of each material, and represents the thermal shrinkage of a single body when heated at the heating temperature for 60 minutes.

Each width ratio in Table 1 is normalized based on Comparative Example 1-1 such that Comparative Example 1-1 has the width of 1.

Each width ratio in Table 2 is normalized based on Comparative Example 1-2 such that Comparative Example 1-2 has the width of 1.

Each width ratio in Table 3 is normalized based on Example 1-8 such that Example 1-8 has the width of 1.

Figure 5E:
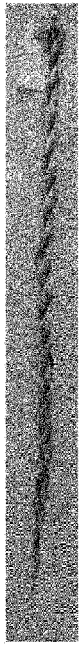
Figure 5E:
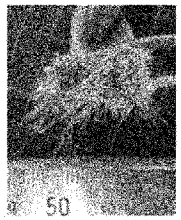
Figure 5D:
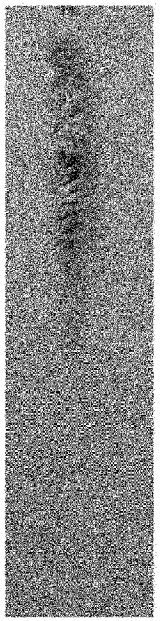
Figure 5D:
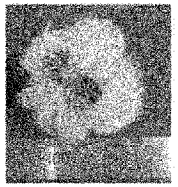
Figure 5C:
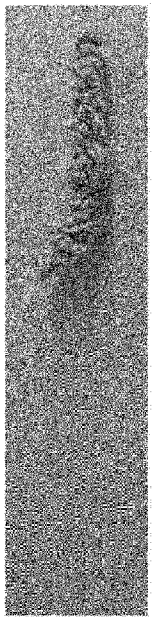
Figure 5C:
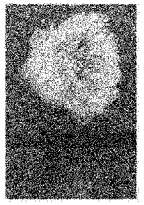
Figure 5B:
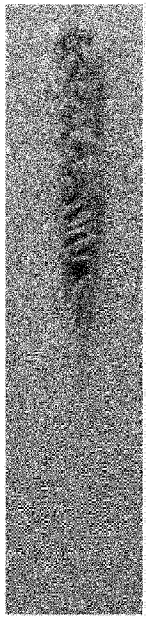
Figure 5B:
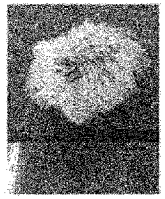
Figure 5A:
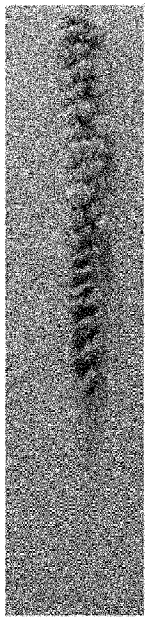
Figure 5A:
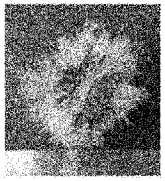

In Comparative Example 1-1, as shown in FIG. 5E, the first fiber and the second fiber were uniformly blended on the cross section orthogonal to the longitudinal direction, and the ratio of the first fiber to the second fiber was substantially uniform. On the other hand, in Examples 1-1 to 1-4, as illustrated in FIG. 5A to FIG. 5D, the first fibers were locally concentrated on the cross section, and the core composed of the first fiber and the second fiber and the shell composed of only the second fiber were clearly separated. As illustrated in FIG. 5A to FIG. 5D, the total length was reduced as the heating temperature increased, and the size of the core with respect to the entire cross section was reduced in Examples 1-1 to 1-4.

In Examples 1-1 to 1-4 in which the core and the shell were formed, as illustrated in FIG. 5A to FIG. 5D, it was found that the total area of the voids of the shell was larger than the total area of the voids of the core on the cross section.

As shown in Table 1, as compared with Comparative Example 1-1 in which the heating temperature was lower than the softening point of the HI-PVC fiber, the width widened by 90% or more in Examples 1-1 to 1-4 in which the heating temperature was higher than the softening point of the HI-PVC fiber. The width ratio decreased as the heating temperature increased.

As shown in Table 1, in Examples 1-1 to 1-4, the ratio of the core area to the total area was smaller than the ratio (30%) of the mass of the first fiber to the total mass, and the ratio of the shell area to the total area was larger than the ratio (70%) of the mass of the second fiber to the total mass. That is, in Examples 1-1 to 1-4 in which the heating temperature was higher than the softening point of the HI-PVC fiber, the ratio of the shell area to the core area was larger than the ratio (70/30) of the mass of the second fiber to the mass of the first fiber.

As shown in Table 2, as compared with Comparative Example 1-2 in which the heating temperature was set to a temperature equal to or more than the softening point of the first fiber and the second fiber, the width ratio increased by 30% or more in Example 1-2, Example 1-5, and Example 1-6 in which the heating temperature was set to be higher than the softening point of the first fiber and lower than the softening point of the second fiber.

As compared with Comparative Example 1-2 in which the thermal shrinkage at the heating temperature of the first fiber and the second fiber was 10% or more, the width ratio increased by 30% or more in Example 1-2, Example 1-5, and Example 1-6 in which the thermal shrinkage at the heating temperature of the first fiber was 10% or more and the thermal shrinkage at the heating temperature of the second fiber was 5% or less; and particularly the width ratio increased by 50% or more in Example 1-2 and Example 1-6 in which the thermal shrinkage at the heating temperature of the second fiber was less than 1%.

When Example 1-2 and Example 1-6 having different Young's moduli of the first fibers were compared, the width ratio of Example 1-2 having a higher Young's modulus was larger than that of Example 1-6.

Comparing Example 1-2, Example 1-5, and Comparative Example 1-2 in which the Young's moduli of the second fibers were different, the width ratio increased as the Young's modulus increased.

In Example 1-2, Example 1-5, and Example 1-6 in which the cross section was divided into the core and the shell, the width ratio was higher by 30% or more than that in Comparative Example 1-2 in which the cross section was not divided into the core and the shell.

In particular, in Example 1-2 in which the ratio of the shell area to the core area was larger than the ratio of the mass of the second fiber to the mass of the first fiber, the width ratio was improved by 80% as compared with Comparative Example 1-2.

As shown in Table 3, in Example 1-2, Example 1-7, and Example 1-8 having different mass ratios, the width ratio increased as the mass ratio of the second fiber increased.

In each of Example 1-2, Example 1-7, and Example 1-8, the ratio of the core area to the total area was smaller than the ratio of the mass of the first fiber to the total mass, and the ratio of the shell area to the total area was larger than the ratio of the mass of the second fiber to the total mass. That is, in Example 1-2, Example 1-7, and Example 1-8, the ratio of the shell area to the core area was larger than the ratio of the mass of the second fiber to the mass of the first fiber.

From the above, it was suggested that by heating at the heating temperature equal to or more than the softening point of the first fiber, using a fiber having a thermal shrinkage of 10% or more at the heating temperature as the first fiber, and using a fiber having a thermal shrinkage of 5% or less at the heating temperature as the second fiber, the first fiber shrinks during heating, the second fiber is pushed outward, the shell area increases, and the volume of the width is improved.

Example 2-1

First, HI-PVC fiber was used as the first fiber, and PET fiber was used as the second fibers.

The first fiber and the second fiber were each cut into 20 inches, and a brush was installed on a desk. The fiber bundle was brushed on the brush to shift the tips, and brushing was performed so that the total length was 25 inches and thus a single fiber bundle was formed.

The fiber bundle was fixed to a pipe having a diameter of 0.2 inches with rubber at the tip of the fiber, and the fiber was wound around the pipe in a spiral shape without being twisted to form a fiber cord.

The fiber cord fixed to the pipe was placed in an oven and preheated under the conditions of a preheating temperature of 90° C. and a preheating time of 20 minutes.

Once the preheating was completed, the fiber cord fixed to the pipe was taken out of the oven, the fiber cord was removed from the pipe, only the fiber cord was placed in the oven again, and the fiber cord was mainly heated under the conditions of a heating temperature of 90° C. and a heating time of 20 minutes.

After completion of the main heating, the fiber bundle was taken out of the oven and was cooled naturally until the fiber bundle reached room temperature.

The fiber bundle thus formed was designated as Example 2-1.

Example 2-2

Except that the heating temperature was set to be 100° C., the same procedure as in Example 2-1 was carried out to obtain a fiber cord as Example 2-2.

Example 2-3

Except that the heating temperature was set to be 120° C., the same procedure as in Example 2-1 was carried out to obtain a fiber cord as Example 2-3.

Example 2-4

Except that the heating temperature was set to be 140° C., the same procedure as in Example 2-1 was carried out to obtain a fiber cord as Example 2-4.

Comparative Example 2-1

Except that the heating temperature was set to be 80° C., the same procedure as in Example 2-1 was carried out to obtain a fiber cord as Comparative Example 2-1.

Example 2-5

Except that the MODA fiber was used as the second fiber and the preheating temperature was set to be 80° C., the same procedure as in Example 2-2 was carried out to obtain a fiber cord as Example 2-5.

Example 2-6

Except that the LO-PVC fiber was used as the first fiber, the same procedure as in Example 2-2 was carried out to obtain a fiber cord as Example 2-6.

Comparative Example 2-2

Except that the LO-PVC fiber was used as the second fiber and the preheating temperature was set to be 75° C., the same procedure as in Example 2-2 was carried out to obtain a fiber cord as Comparative Example 2-2.

The results of cross-section observation of Example 2-1 to Example 2-4 and Comparative Example 2-1 are shown in FIGS. 6A to 6E, the measurement results of Example 2-1 to Example 2-4 and Comparative Example 2-1 are shown in Table 4, and the measurement results of Example 2-2, Example 2-5, Example 2-6, and Comparative Example 2-2 are shown in Table 5.

TABLE 4

| | Preheating Temperature (° C.) | Heating Temperature (° C.) | Material | Mass Ratio (%) | Thermal Shrinkage (%) | Difference in Thermal Shrinkage (%) | Area Ratio at Core | Area Ratio at Shell | Width Ratio |
|---|---|---|---|---|---|---|---|---|---|
| Example 2-1 | 90 | 90 | HI-PVC | 30 | 29.8 | 29.3 | 31.1% | 68.9% | 1.10 |
| | | | PET | 70 | 0.5 | | | | |
| Example 2-2 | | 100 | HI-PVC | 30 | 42.3 | 41.7 | 36.3% | 63.7% | 1.12 |
| | | | PET | 70 | 0.6 | | | | |
| Example 2-3 | | 120 | HI-PVC | 30 | 54.2 | 52.9 | 28.5% | 71.5% | 1.50 |
| | | | PET | 70 | 1.3 | | | | |
| Example 2-4 | | 140 | HI-PVC | 30 | 63.2 | 60.5 | 17.6% | 82.4% | 1.50 |
| | | | PET | 70 | 2.7 | | | | |

TABLE 4-continued

| | Preheating Temperature (° C.) | Heating Temperature (° C.) | Material | Mass Ratio (%) | Thermal Shrinkage (%) | Difference in Thermal Shrinkage (%) | Area Ratio at Core | Area Ratio at Shell | Width Ratio |
|---|---|---|---|---|---|---|---|---|---|
| Comparative Example 2-1 | | 80 | HI-PVC | 30 | 12.5 | 12 | — | — | 1.00 |
| | | | PET | 70 | 0.5 | | | | |

TABLE 5

| | Preheating Temperature (° C.) | Heating Temperature (° C.) | Material | Mass Ratio (%) | Softening Point (° C.) | Young's Modulus (GPa) | Thermal Shrinkage (%) | Difference in Thermal Shrinkage (%) | Width Ratio |
|---|---|---|---|---|---|---|---|---|---|
| Example 2-2 | 90 | 100 | HI-PVC | 30 | 80.9 | 4.2 | 42.3 | 41.7 | 1.49 |
| | | | PET | 70 | 212.4 | 5.6 | 0.6 | | |
| Example 2-5 | 80 | 100 | HI-PVC | 30 | 80.9 | 4.2 | 42.3 | 40.8 | 1.43 |
| | | | MODA | 70 | 135.4 | 4.7 | 1.5 | | |
| Example 2-6 | 90 | 100 | LO-PVC | 30 | 99.7 | 3 | 17.8 | 17.2 | 1.05 |
| | | | PET | 70 | 212.4 | 5.6 | 0.6 | | |
| Comparative Example 2-1 | 75 | 100 | HI-PVC | 30 | 80.9 | 4.2 | 42.3 | 24.5 | 1.00 |
| | | | LO-PVC | 70 | 99.7 | 3 | 17.8 | | |

The thermal shrinkage is an intrinsic thermal shrinkage of each material, and represents the thermal shrinkage of a single body when heated at the heating temperature for 60 minutes.

Each width ratio in Table 4 is normalized such that the width of Comparative Example 2-1 is 1, and each width ratio in Table 5 is normalized such that the width of Comparative Example 2-2 is 1.

Figure 6E:
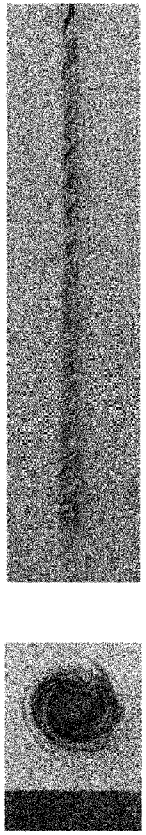
Figure 6D:
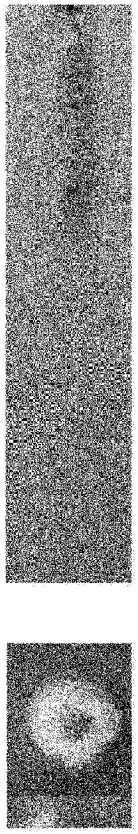
Figure 6C:
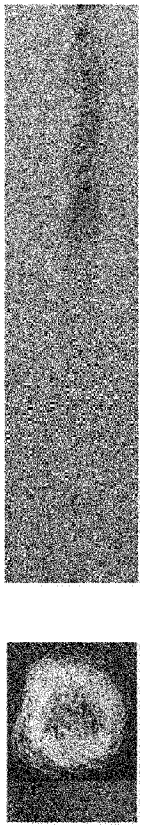
Figure 6B:
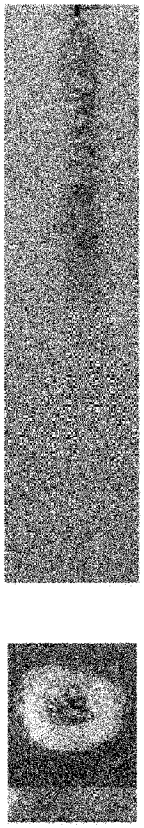
Figure 6A:
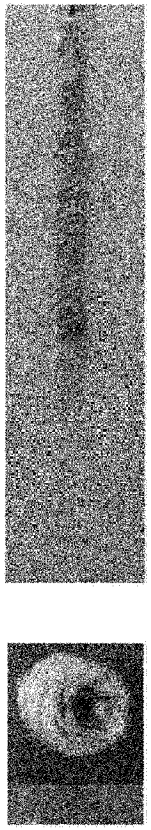

In Comparative Example 2-1, as shown in FIG. 6E, the first fiber and the second fiber were uniformly blended on the cross section orthogonal to the longitudinal direction, and the ratio of the first fiber to the second fiber was substantially uniform. On the other hand, in Examples 2-1 to 2-4, as illustrated in FIG. 6A to FIG. 6D, the first fibers were locally concentrated on the cross section, and the core composed of the first fiber and the second fiber, and the shell composed of only the second fiber were clearly separated. As illustrated in FIGS. 6A to 6D, the total length was reduced as the heating temperature increased, and the size of the core with respect to the entire cross section was reduced in Examples 2-1 to 2-4.

In Examples 2-1 to 2-4 in which the core and the shell were formed, as illustrated in FIG. 6A to 6D, it was found that the total area of the voids of the shell was larger than the total area of the voids of the core on the cross section.

As shown in Table 4, as compared with Comparative Example 2-1 in which the heating temperature was lower than the softening point of polyvinyl chloride, the width increased by 10% or more in Examples 2-1 to 2-4 in which the heating temperature was higher than the softening point of polyvinyl chloride, and in particular, the width increased by 50% or more in Examples 2-3 and 2-4.

In Examples 2-1 and 2-2, the ratio of the core area to the total area was larger than the ratio (30%) of the mass of the first fiber to the total mass, and the ratio of the shell area to the total area was small than the ratio (70%) of the mass of the second fiber to the total mass. That is, in Examples 2-1 and 2-2, the ratio of the shell area to the core area was smaller than the ratio (70/30) of the mass of the second fiber to the mass of the first fiber.

On the other hand, in Examples 2-3 and 2-4 in which the width is remarkably expanded, the ratio of the core area to the total area was smaller than the ratio (30%) of the mass of the first fiber to the total mass, and the ratio (70%) of the shell area to the total area was larger than the ratio of the mass of the second fiber to the total mass.

That is, in Examples 2-3 and 2-4, the ratio of the shell area to the core area was larger than the ratio (70/30) of the mass of the second fiber to the mass of the first fiber.

As shown in Table 5, as compared with Comparative Example 2-2 in which the heating temperature was set to a temperature equal to or more than the softening point of the first fiber and the second fiber, the width ratio increased by 5% or more in Example 2-2, Example 2-5, and Example 2-6 in which the heating temperature was set to be higher than the softening point of the first fiber and lower than the softening point of the second fiber.

As compared with Comparative Example 2-2 in which the thermal shrinkage at the heating temperature of the first fiber and the second fiber was 10% or more, the width ratio increased by 5% or more in Example 2-2, Example 2-5, and Example 2-6 in which the thermal shrinkage at the heating temperature of the first fiber was 10% or more and the thermal shrinkage at the heating temperature of the second fiber was 5% or less; and particularly the width ratio increased by 40% or more in Example 2-2 and Example 2-5 in which the difference between the thermal shrinkages of the first and second fibers was 40% or more.

When Example 2-2 and Example 2-6 having different Young's moduli of the first fibers were compared, the width ratio of Example 2-2 having a higher Young's modulus was larger than that of Example 2-6.

Comparing Example 2-2, Example 2-5, and Comparative Example 2-2 in which the Young's moduli of the second fibers were different, the width ratio increased as the Young's modulus increased.

As described above, based on the results of Examples 2-1 to 2-6 subjected to the preheating step and the heating step, it was suggested that by heating at the heating temperature equal to or more than the softening point of the first fiber, using a fiber having a thermal shrinkage of 10% or more at the heating temperature as the first fiber, and using a fiber having a thermal shrinkage of 5% or less at the heating temperature as the second fiber, the first fiber shrinks during heating, the second fiber is pushed outward, the shell area increases, and the volume of the width is improved.

From the above results, it was found that by using the first fiber having the thermal shrinkage of 10% or more when heated at the heating temperature equal to or more than the softening point of the first fiber for 60 minutes as the first fiber and using the second fiber having the thermal shrinkage of 5% or less when heated at the heating temperature for 60 minutes as the second fiber, it is possible to form a fiber cord having a cross section having a core and a shell with different porosities and having an irregular, fluffy and voluminous shape as compared with the prior art.

EXPLANATION OF REFERENCE SIGNS

1, 101: Artificial hair
2, 102: Fiber cord
3: Fiber bundle
5: First fiber
6: Second fiber
10: Core
11: Shell
12: Nonwoven fabric
16, 17: Void Although the disclosure has been described with respect to only a limited number of embodiments, those skilled in the art, having benefit of this disclosure, will appreciate that various other embodiments may be devised without departing from the scope of the present disclosure. Accordingly, the scope of the invention should be limited only by the attached claims.

The invention claimed is:

1. Artificial hair comprising a fiber cord including one or more fiber bundles braided or spirally wound, wherein the fiber bundle includes a plurality of fibers including a first fiber and a second fiber, and the plurality of fibers are bundled together, a cross section that is orthogonal to a longitudinal direction of the fiber bundle includes:

a core; and a shell enclosing the core, wherein the core includes the first fiber and the second fiber in a mixed state, and the shell consists of the second fiber, and a total area of voids in the shell in the cross section is larger than a total area of voids in the core in the cross section.

2. The artificial hair according to claim 1, wherein the fiber bundle has a ratio of a shell area to a core area in the cross section larger than a ratio of mass of the second fiber to mass of the first fiber.

3. The artificial hair according to claim 1, wherein the second fiber comes from an inside of the core, passes through a gap between adjacent first fibers, and reaches the shell.

4. The artificial hair according to claim 1, wherein the shell area is larger than the core area in the cross section.

5. The artificial hair according to claim 1, wherein a minimum thickness of the shell in the cross section is 0.1 mm or more.

6. The artificial hair according to claim 1, wherein a mass of the second fiber is 20 to 80 parts by mass based on a total of 100 parts by mass of the first and second fibers.

7. The artificial hair according to claim 6, wherein the mass of the second fiber is 50 parts by mass or more based on the total of 100 parts by mass of the first and second fibers.

8. The artificial hair according to claim 1, wherein a length of the first fiber is 20 inches or more.

* * * * *